US006897772B1

(12) United States Patent
Scheffler et al.

(10) Patent No.: US 6,897,772 B1
(45) Date of Patent: May 24, 2005

(54) MULTI-FUNCTION CONTROL SYSTEM

(75) Inventors: Daniel C. Scheffler, Winfield, IL (US); Simon Ha, Aurora, IL (US); Daniel J. Austin, Streamwood, IL (US)

(73) Assignee: Honeywell International, Inc., Morristown, NJ (US)

( * ) Notice: Subject to any disclaimer, the term of this patent is extended or adjusted under 35 U.S.C. 154(b) by 446 days.

(21) Appl. No.: 10/008,537

(22) Filed: Nov. 13, 2001

Related U.S. Application Data

(60) Provisional application No. 60/248,420, filed on Nov. 14, 2000.

(51) Int. Cl.[7] ..... G08B 29/00

(52) U.S. Cl. ..... 340/506; 340/538; 340/3.1; 340/3.2

(58) Field of Search ..... 340/506, 531, 340/534, 537, 538, 3.1, 3.2

(56) References Cited

U.S. PATENT DOCUMENTS

| | | | | |
|---|---|---|---|---|
| 4,262,286 A | | 4/1981 | Tanigawa | |
| 4,274,084 A | | 6/1981 | Haus | |
| 4,540,890 A | | 9/1985 | Gangemi et al. | |
| 4,549,146 A | * | 10/1985 | Cowans et al. | 330/149 |
| 4,555,695 A | | 11/1985 | Machida et al. | |
| 4,785,195 A | | 11/1988 | Rochelle et al. | |
| 4,951,081 A | | 8/1990 | Hosomizu et al. | |
| 5,019,805 A | | 5/1991 | Curl et al. | |
| 5,400,246 A | | 3/1995 | Wilson et al. | |
| 5,525,962 A | | 6/1996 | Tice | |
| 5,559,492 A | | 9/1996 | Stewart et al. | |
| 5,570,077 A | | 10/1996 | Swieboda | |
| 5,598,139 A | | 1/1997 | Karim et al. | |
| 5,608,375 A | | 3/1997 | Kosich | |
| 5,659,287 A | | 8/1997 | Donati et al. | |
| 5,694,118 A | | 12/1997 | Park et al. | |
| 5,701,115 A | | 12/1997 | Right et al. | |
| 5,731,731 A | * | 3/1998 | Wilcox et al. | 327/403 |
| 5,751,210 A | | 5/1998 | Kosich | |
| 5,959,528 A | | 9/1999 | Right et al. | |
| 6,144,256 A | * | 11/2000 | Barbetta | 330/255 |
| 6,175,321 B1 | * | 1/2001 | Frannhagen et al. | 341/143 |
| 6,281,789 B1 | | 8/2001 | Furtado et al. | |
| 6,311,021 B1 | | 10/2001 | Kosich | |

OTHER PUBLICATIONS

Wheelock Inc., Fire Alarm Systems, Series AMT and AMT Strobe Multitone Electronic Appliances for New York City, brochure, MEA 151–92–E, vol. 21, Copyright 1998 Wheelock, Inc. All rights reserved.

System Sensor, SpectrAlert™Sync•Circuit™ Module, © 1999 System Sensor.

* cited by examiner

*Primary Examiner*—Daryl C. Pope
(74) *Attorney, Agent, or Firm*—Welsh & Katz, Ltd.

(57) ABSTRACT

A control module usable to drive audible or audible/visible output devices in an alarm system can generate a modulated pulse sequence in accordance with a desired output function. Sequence initiating pulses can be transmitted to output devices with a predetermined, substantially constant period. Additional pulses can be coupled to the output devices, between the initiating pulses, and later in time based on functions to be carried out by the output devices. The output devices in turn demodulate the received pulse train and determine the requested function which is then implemented to provide a desired audible or visual alarm indicating output.

43 Claims, 9 Drawing Sheets

MULTI-FUNCTION CONTROL SYSTEM

This Utility Application claims the benefit of Provisional Application Ser. No. 60/248,420, filed Nov. 14, 2000.

FIELD OF THE INVENTION

The invention pertains to communications protocols and circuitry for the control of audible and/or visual alarm indicating output devices. More particularly, the invention pertains to such protocols and circuitry wherein composite audible/visible control signals are used to control such output devices.

BACKGROUND OF THE INVENTION

Systems are known for providing synchronizing signals to pluralities of visible or audible/visible alarm indicating output devices. One such system has been disclosed in Karim et al U.S. Pat. No. 5,598,139 assigned to the assignee hereof and incorporated by reference.

Control of the audible devices or the audible portion of audible/visual devices enables output of a variety of alarm indicating audible outputs. Since it is known to be desirable to couple the number of audible, visible or audible/visible devices to a common loop and synchronize the visible devices on the loop, it would be desirable to incorporate audible control sequences into the synchronization process. Preferably, such an enhancement could be implemented so as to impose minimal technical and financial costs on the output devices. It would also be preferable if the control information conveying process was compatible with conventional ways in which such output devices are operated.

As is known, such output devices are usually driven by a reverse polarity signal, when inactive, for purposes of supervising the communication lines. To activate the output devices, the polarity is reversed providing electrical energy to the devices, at a predetermined voltage. This power carrying signal is interruptible for purposes of synchronizing visual output devices coupled to the link, as taught by Karim et al U.S. Pat. No. 5,598,139. Such synchronizing signals usually take the form of pulses from the predetermined voltage going to a ground level for the loop and then returning to the predetermined voltage.

SUMMARY OF THE INVENTION

A control module usable to control audible and/or visual output devices includes a plurality of ports. One port is for receipt of electrical energy from an external source, for example, an alarm system control unit or a power supply. Another input port receives a signal or signals, also for example from the system control unit, specifying a repetitive composite audible and/or visible command signal.

One type of output port drives a plurality of output devices such as sounders, horns, strobes, and/or combination units. This type of port can be configured for Class A or Class B operation. A plurality of output devices can be coupled to this port by a communication loop.

For purposes of chaining multiple modules together, each module can include a lock-step output, a master, drive port and a lock-step, input, or slave, port. Either a lock-step output port can be coupled to a lock-step input port to cause a downstream module to emit the same sequence as the master module. Alternatively, the same output device communication loop for the master module, to which output devices are coupled, can be coupled to the lock-step input port of the downstream module. An end-of-line resistor can be physically positioned adjacent to the input port for the downstream module. This permits the master to supervise the physical communication link between itself and the first downstream module. Subsequent downstream modules can be supervised by their immediate preceding master module in the same fashion.

In accordance with the present invention, the amplitude of a power supplying signal, coupled to the output devices being controlled, can be modulated using a pulse width modulation process or protocol. A selected signal duration can be varied in accordance with a desired function to be implemented.

For example, and without limitation, signals on the output device communication lines could be sequences of pulses. Pulses can be transmitted with a one second period to control and synchronize strobe units coupled to the communication lines. Other periods can also be provided. Additional pulses can be interposed between the strobe synchronizing pulses.

The time interval or intervals between pulses can be modulated in accordance with a desired output function. Representative functions include, without limitation, turning strobe units on and off, providing continuous or interrupted audible tones of various types or selecting light output levels, candela select, for strobe units being driven by the respective module.

In one embodiment, the strobe units can be synchronized to a one second period based on an up-going or a down-going edge of a synchronizing pulse in a signal which supplies operating power to the output devices. One or more pulses can be impressed onto the signal, between synchronizing pulses, such that information is transferred, via a pulse width, or a pulse position modulation scheme while the signal is supplying operating power to the devices.

It will be understood that a variety of other modulation sequences could be used without departing from the spirit and scope of the present invention. Advantageous modulation sequences, variations on the above, include multiple pulses with varying durations therebetween. Such modulation schemes are useful in that modulated waveforms can be easily and inexpensively generated and demodulated at the output devices for reliable and cost effective performance. The control information is transferred before or after the synchronizing pulses while power is being coupled to the output devices.

Audible output devices, or, audible/visual output devices include control circuitry, and preferably, executable instructions for responding to received modulated pulse sequences. The responses include sensing the initial pulses in the sequence having a one second period and then measuring the time interval between when an interval initiating pulse exhibits a transition and when a subsequent pulse exhibits a transition.

The time interval between the transitions of interest can be measured and compared to a prestored table, for example, for purposes of ascertaining a desired control function. Other types of control processing can be implemented without departing from the spirit and scope of the present invention.

Control modules in accordance with the present invention require only pattern specification information and electrical energy of an appropriate polarity from a respective region monitoring control unit. Typical region monitoring control units include fire alarm and/or building control systems.

The present module, in response to receipt of electrical energy and a pattern specification signal generates modulated pulse trains, of the general type discussed above, on one or more local transmission links. Where necessary additional modules and additional output devices can be synchronized by using the initial modulated pulse train as a synchronizing signal for all subsequent down-stream, interconnected modules.

A method of controlling output units includes:

specifying an output device command; generating, in response to the command, a modulated output signal sequence having a predetermined period and a fixed, repetitive, modulation independent period initiating pulse wherein the modulated portion of the sequence lies outside of any synchronizing signals.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
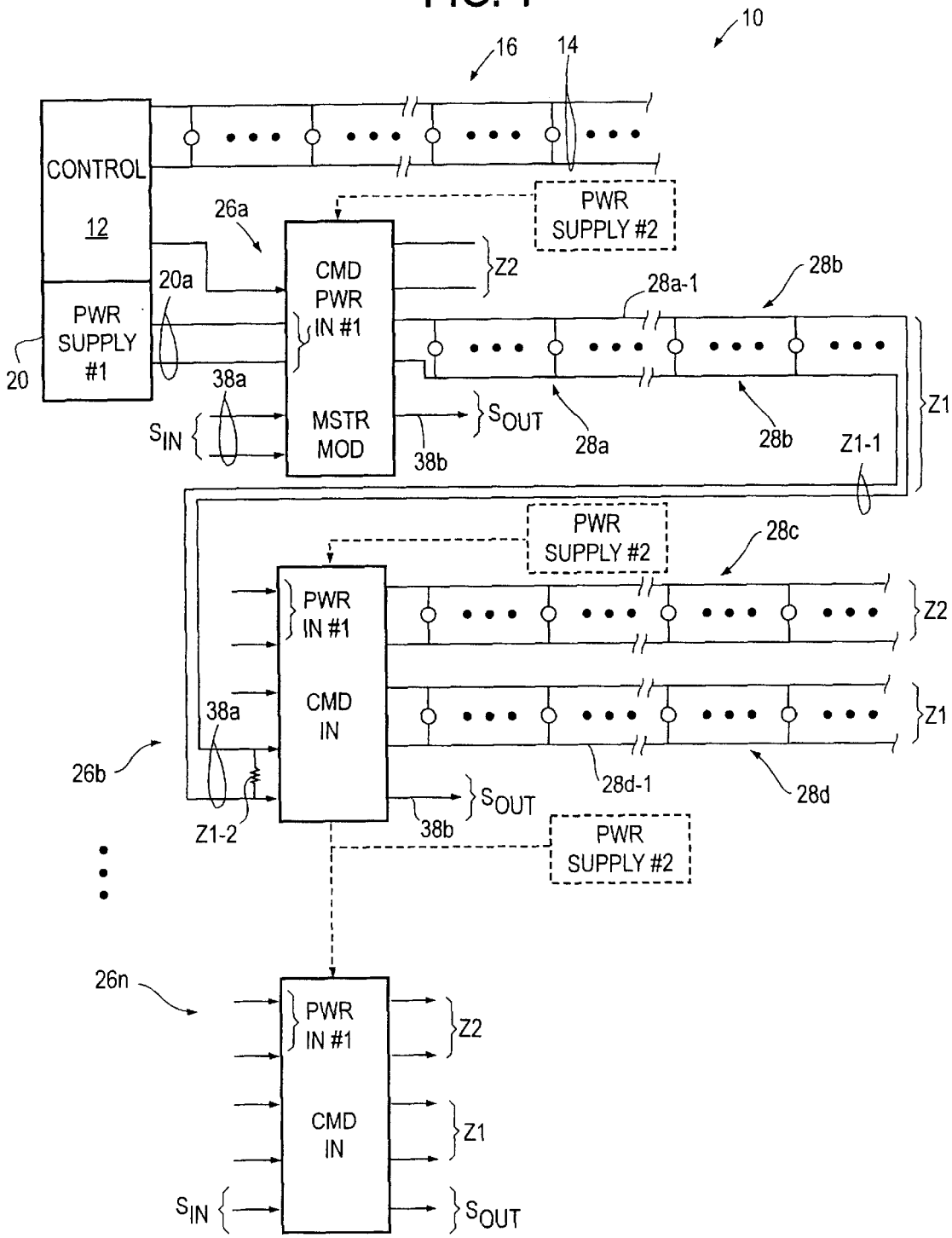
FIG. 1 is a block diagram of a monitoring system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 is a over-all block diagram of a system 10 which could be, for example, a building monitoring system, such as, a fire alarm system. The system 10 includes a common control element 12 which communicates via communication link 14 with a plurality of detectors 16.

It will be understood that the members of the plurality 16 could include fire, smoke, gas, thermal, intrusion, motion, or position detectors, all without limitation. The exact details of the members of the plurality 16 are not a limitation of the present invention.

The communication link 14 can provide bidirectional communication between members of the plurality 16 and the common control element 12. The control element 12 could include one or more programmed processors as would be understood by those of skill in the art. The control element 12 could also alone or in combination with processing at the members of the plurality 16 carry out one or more alarm determinations based on distributed sensed ambient conditions.

The control element 12 also includes a switchable power supply 20 which operates under control of the element 12. The output from the supply 20, via lines 20*a*, can exhibit first and second polarities.

When the power supply 20 is exhibiting a first or inactive polarity, it applies a voltage across the lines 20*a* for purposes of causing a supervisory current flow therein without at the same time activating any other devices coupled to the lines 20*a*. To activate other circuitry coupled to the lines 20*a*, the power supply 20 switches the polarity of the output voltage from the first, inactive/supervisory polarity, to a second active polarity. During the time in which the lines 20*a* exhibit the active polarity, power supply 20 is intended to deliver electrical energy to any and all downstream devices coupled thereto for the purpose of activating and energizing same.

The system 10 also includes a plurality of substantially identical output synchronization modules such as 26*a*, 26*b*. . . 26*n*. As discussed in more detail subsequently, the members of the plurality 26 are intended to drive and to control pluralities of alarm indicating output devices such as pluralities 28*a*, 28*b* 27*c* and 28*d*.

The output devices 28*a, b, c, d* can include audible and/or visible alarm indicating output devices such as horns, sounders, sirens, strobe lights or combinations thereof, all without limitation. Except as discussed subsequently, the details of such output devices are not limitations of the present invention. The members of the plurality 26 communicate with respective members of the pluralities 28*a, b, c, d* via a communication protocol which is effective to not only energize the output devices 28*a*, 28*b*, 28*c* and 28*d* but also to control same using power supplied to respective wire loops such as 28*a*-1, 28*d*-1.

Figure 2:
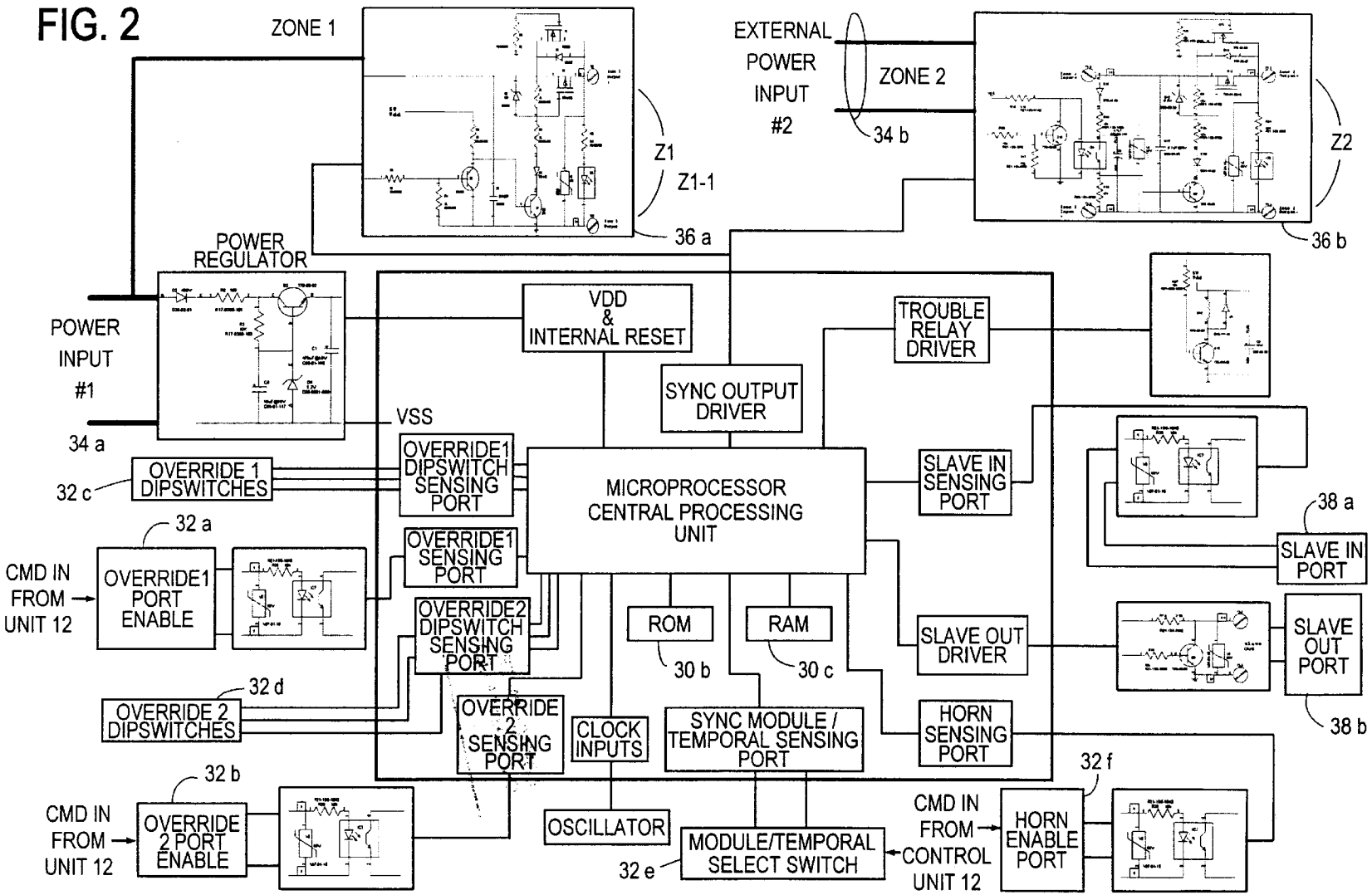
FIG. 2 is a block diagram of a representative synchronizing control module in accordance with the present invention.

The members of the plurality 26 are illustrated by exemplary module 26*i* in block diagram form in FIG. 2. A discussion of module 26*i* will suffice as a discussion of all of the other members of the plurality 26.

Module 26*i* includes an instruction executing processing unit 30*a* to which are coupled programmable read only memory 30*b* and read/write memory 30*c*. Executable instructions can be stored in programmable read only memory 30*b* for execution by processor 30*a*. Other information of a transient nature can be stored in read/write memory 30*c* as will be understood by those of skill in the art.

Control signals from an external device, such as control unit 12, can be coupled to processor 30*a* via, respectively, enable ports 32*a, b*, and *f* and respective manually settable output pattern specifying switches 32*c*, 32*d* and audible select switch 32*e*. Processor 30*a* in response to electrical energy applied, with an active polarity at power input port No. 1, 34*a* and in combination with one or more command signals derived from inputs such as 32*c, d* or *e* will output communications signals, via line 30*d* from output driver 30*e* which conform to the present communication protocol for driving pluralities of audible, visible, or audible/visible output devices such as 28*a, b, c* and *d*.

Module 26*i* includes zoned communication line driving circuitry 36*a*, zone 1, and 36*b*, zone 2 so as to be able to drive output devices in two different zones if desired. In this regard, while zone 1 circuitry is powered off of power supply at power input No. 1, lines 34*a*, the zone 2 circuitry 36*b* can be optionally powered off of a separate external, possibly switched power supply No. 2 (best seen in FIG. 1 in phantom).

The module 26*i* includes a slave input port 38*a* and a slave output port 38*b* for purposes of sequentially coupling modules in a master-slave relationship. In this regard, with respect to FIG. 1, module 26*a* is coupled via zone 1 communication lines Z1-1 to slave input port 38*a* of module 26*b*. In this configuration, communications lines Z1-1 can be supervised by the master module 26*a* if a termination resistor Z1-2 is coupled across the lines Z1-1 adjacent to slave input port 38*a* of module 26*b*.

Alternately, slave output port 38*b* of the respective module such as module 26*a* can be directly coupled to slave input port, such as port 38*a* of module 26*b*. In this configuration, communication lines Z1-1 are not coupled to input port 38*a*.

Figure 3:
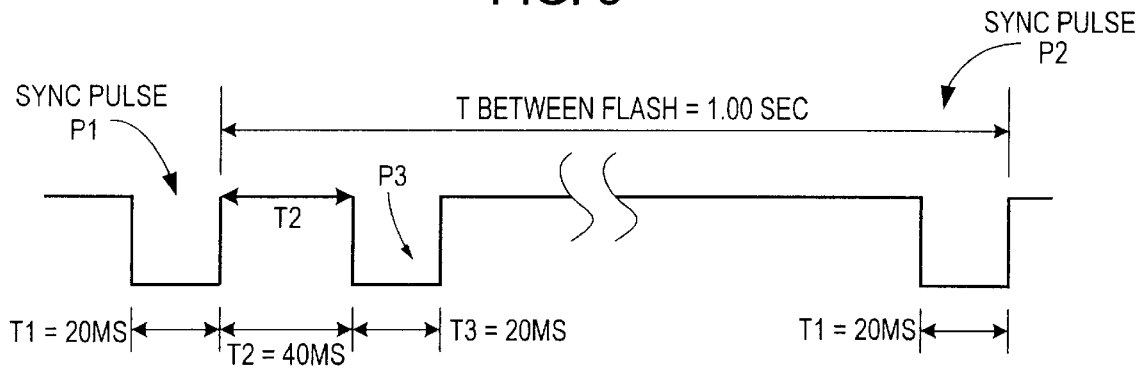
FIGS. 3–5 each illustrate various aspects of a communications protocol in accordance with the present invention.
Figure 4:
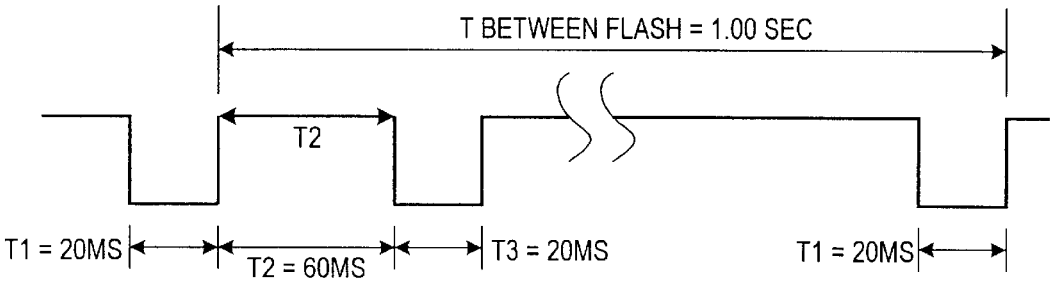
Figure 5:
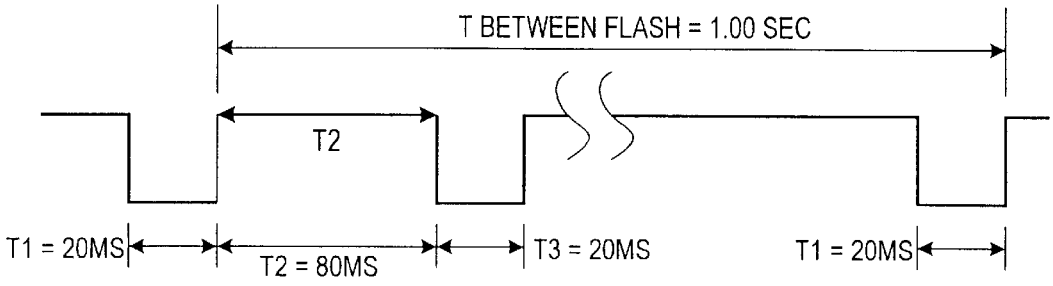

FIGS. 3–5 illustrate three examples of the present communications protocol in carrying out three exemplary functions, namely:

force audible output device (sounder) to continuous electromechanical sound;

force audible output device (sounder) to temporal EM sound;

force audible output device (sounder) to double march time (⅛ sec.) EM sound.

Each of FIGS. 3–5 illustrate a different durational interval t2. The modulatable duration between an initial synchronization pulse P1 and a subsequent synchronization pulse P2 is delineated by an up-going edge of synch pulse P1 followed by the modulatable energy transferring interval t2 which is in turn terminated by a down-going end pulse P3. Various durational interval increments can be used without departing from the spirit and scope of the present invention.

At the end of pulse P3, the output lines, such as Z1-1, are returned to an energy providing state until the appearance of the next synchronizing pulse P2. Thus, the modulatable energy transferring intervals t2 are monitored by each of the output devices in pluralities 28*a, b, c* and d. The output devices in turn respond to the sensed modulatable energy transferring intervals t2 to audibly output the specified pattern as indicated above, or to carry out additional audible and/or visual control functions such as, for example:

default to audible output device switch settings and resynchronized horn temporal pattern alignment;

force audible output device (sounder) to March Time (¼ second) EM sound;

force audible output device (sounder) to Canadian two-stage (20 strokes/min) EM sound;

turn visible output device (strobe) off and resynchronize sound;

turn visible output device (strobe) back on and resynchronize sound;

select 15 candela strobes;

select 15/75 candela strobes;

select 30 candela strobes;

select 75 candela strobes;

and select 110 candela strobes.

It will be understood that the above functions are exemplary and could be varied without departing from the spirit and scope of the present invention.

Figure 6:
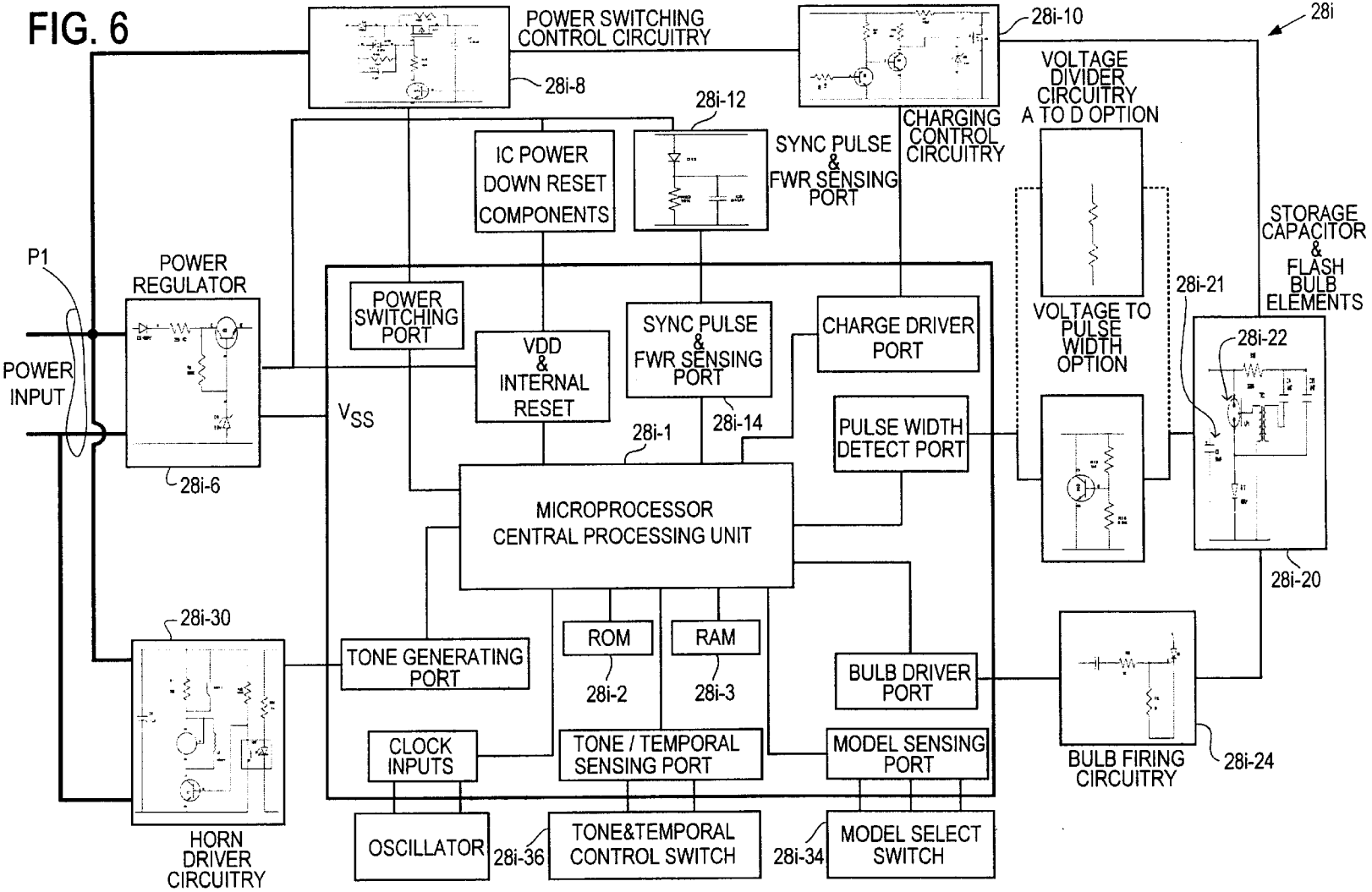
FIG. 6 is a block diagram of an output unit usable in the system of FIG. 1.

Visible output devices, for example strobe units, of the type usable in the present system, have been disclosed and claimed in U.S. patent application Ser. No. 09/767,897 filed Jan. 23, 2001 entitled "Processor Based Strobe" assigned to the assignee hereof and incorporated herein by reference. As those of skill will understand, the incorporated processor based strobe, a block diagram of which is illustrated in FIG. 6, will respond to the modulatable energy transferring intervals t2 of the present protocol and, depending on the duration thereof, will carry out the required function. The processor based strobe of FIG. 6 can also include an audible output device such as a sounder or horn.

FIG. 6 illustrates a block diagram of two embodiments of an audible/visual output device 28*i*, a member of the pluralities 28*a, b, c, d*. The output device 28*i* includes a control element for example a programmable processor, 28*i*-1.

The processor 28*i*-1 is coupled to a read-only or programmable read-only memory 28*i*-2 and read/write memory 28*i*-3. Memory units 28*i*-2, -3 can store executable instructions for carrying out methods discussed subsequently as well as parameters and results of on-going calculations.

A power regulator 28*i*-6 is coupled to power input lines P1. Exemplary circuitry, as would be understood by those of skill in the art, is illustrated in various of the circuit blocks, such as circuit block 28*i*-6.

Lines P provide electrical energy and synchronization pulses. Lines P can be coupled to a pair of output lines Z1 or Z2.

The voltage on the lines P can vary, for example, between 8–40 volts DC. The principles of the present invention can be used with other ranges of input voltages and can be used with half wave or full wave rectified AC input voltages in a exemplary range of 10–33 volts RMS without departing from the spirit and scope of the present invention.

Device 28*i* automatically adjusts to various input voltages. thus, it can be powered without any changes off of 12 volts DC, 24 volts DC or 24 volts RMS rectified AC.

Power control circuitry 28*i*-8 is coupled to lines P and to charging control circuitry 28*i*-10. Processor 28*i*-1 is coupled to circuitry 28*i*-8 and to charging control circuitry 28*i*-10. Processor 28*i*-1 is coupled to regulator 28*i*-6 via sync pulse port 28*i*-12 and sensing port 28*i*-14.

The charging control circuit 28*i*-10 is coupled to circuits 28*i*-20 which include capacitor 28*i*-21 and flash bulb or tube 28*i*-22 and provides electrical energy to charge the capacitor therein using, for example either a variable or a constant frequency, variable duty cycle signal. Bulb firing circuitry 28*i*-24 is coupled to processor 28*i*-1. Where the capacitor in circuit 28*i*-20 has been charged to a predetermined value, based on selected candela output, the processor 28*i*-1 can trigger, or flash the bulb.

Horn driver circuit 28*i*-30 is coupled to processor 28*i*-1 and enables the processor 28*i*-1 to drive an audible output device in accordance with a preselected tonal pattern. The pattern can be controlled by signals received from processor 28*i*-1.

Model select switch 28*i*-34 is coupled to processor 28*i*-1. Switch 28*i*-34 can be set, locally or remotely to specify one or several selected candela outputs, such as 15, 30 or others of interest.

Temporal control switch 28*i*-36 can be set to select an audible tonal output pattern. Switch 28*i*-36 is coupled to processor 28*i*-1.

As will be understood by those of skill in the art, the strobe circuitry can be deleted from the unit of FIG. 6 and a horn or sounder only can be provided. All such visible output devices, combined audible and visible devices or audible only devices, can be incorporated into pluralities 28*a, b, c* or *d*.

Figure 7:
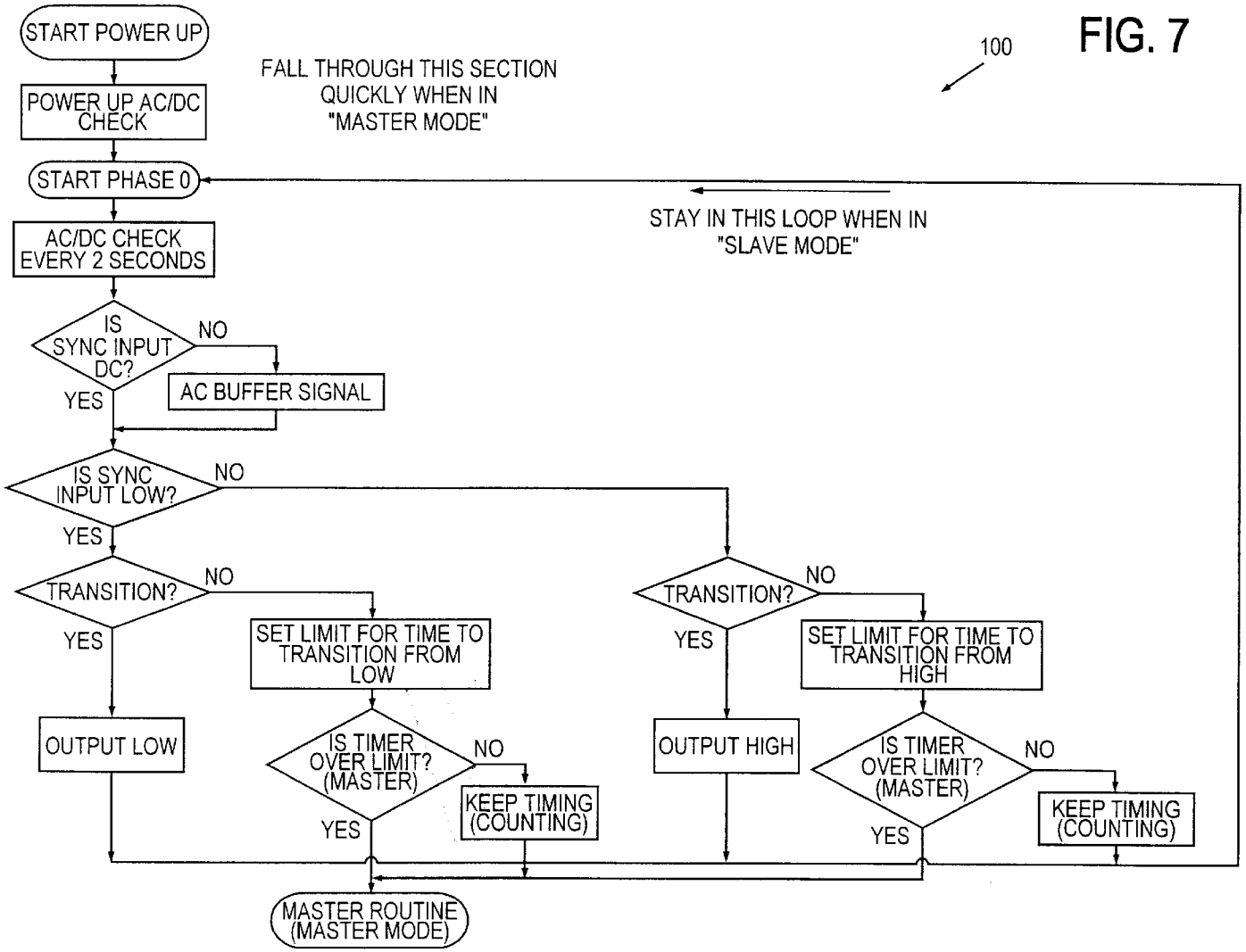
FIGS. 7–9 taken together are a set of flow diagrams which illustrate processing carried out by the module of FIG. 2.
Figure 8:
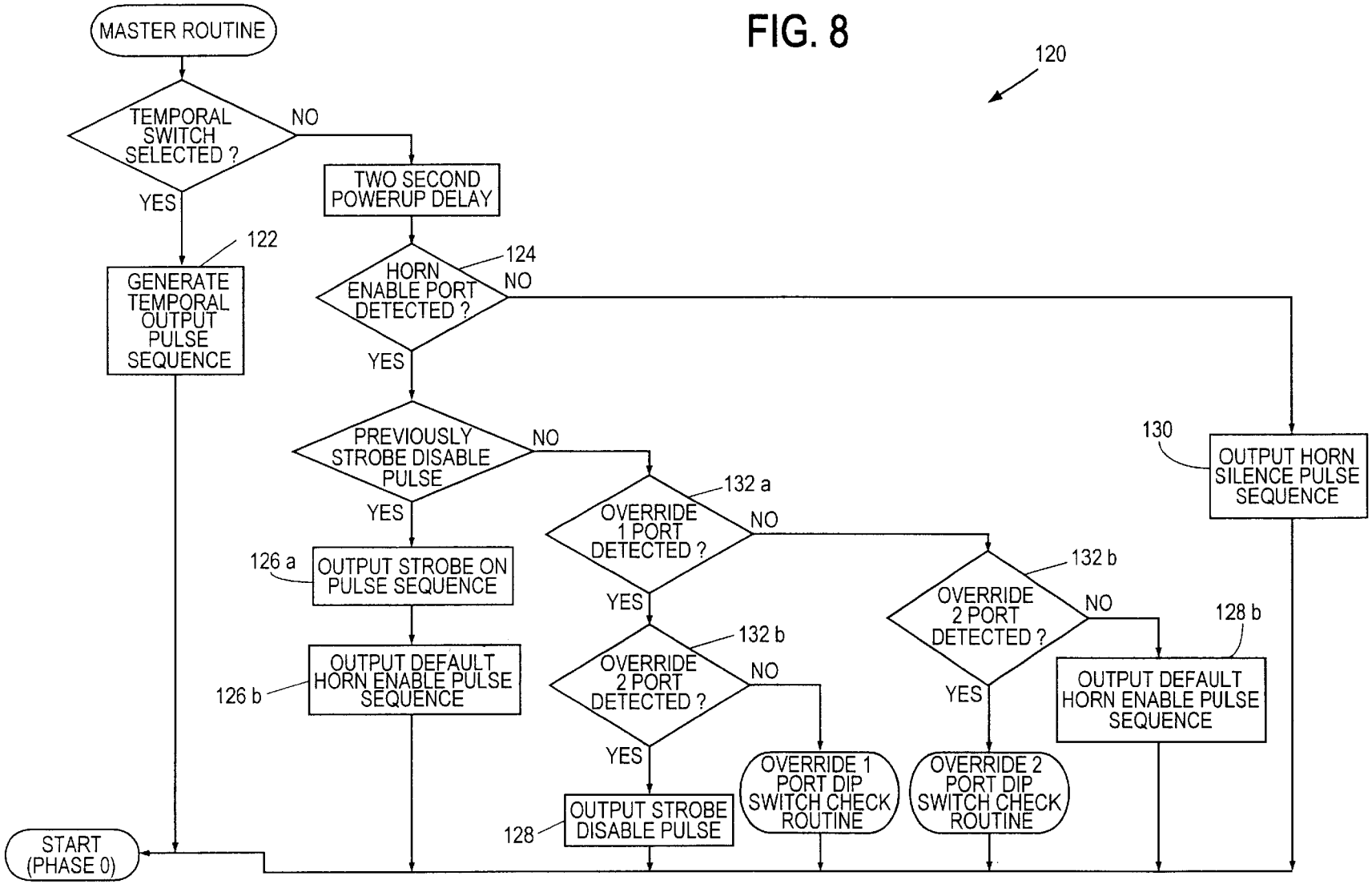
Figure 9:
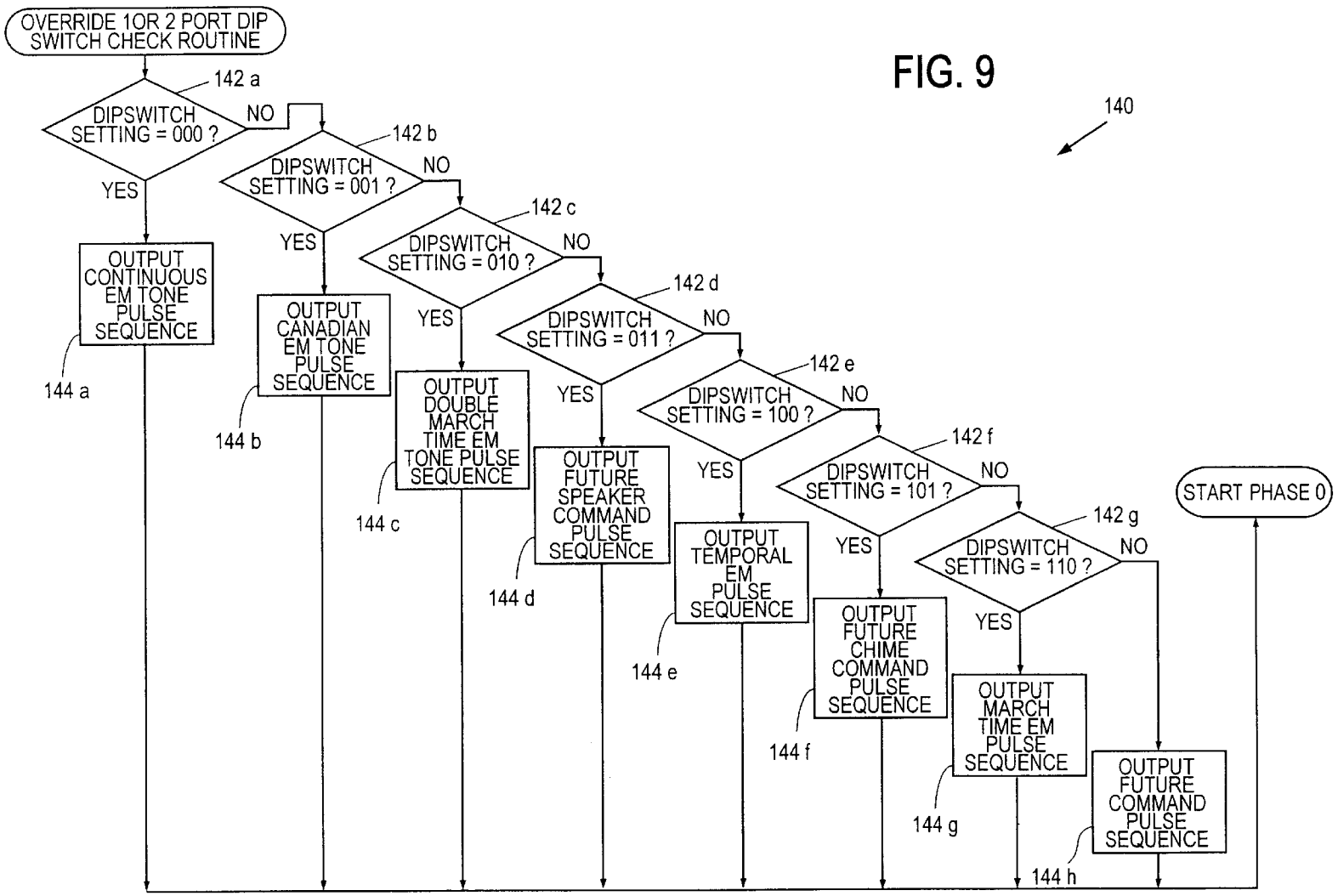
Figure 10:
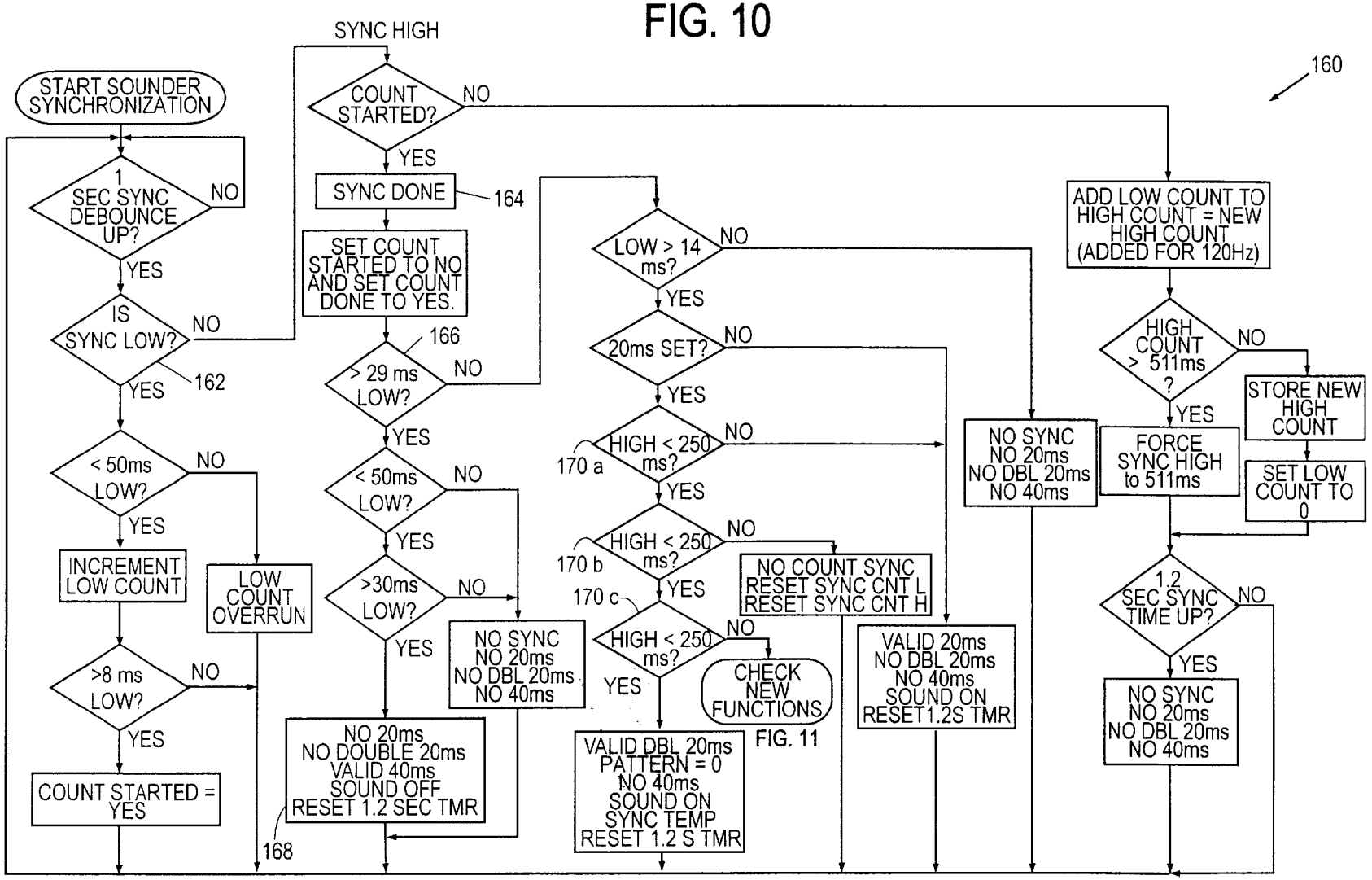
FIGS. 10, 11 taken together as a set of flow diagrams illustrating processing carried out by an output module such as in FIG. 6.
Figure 11:
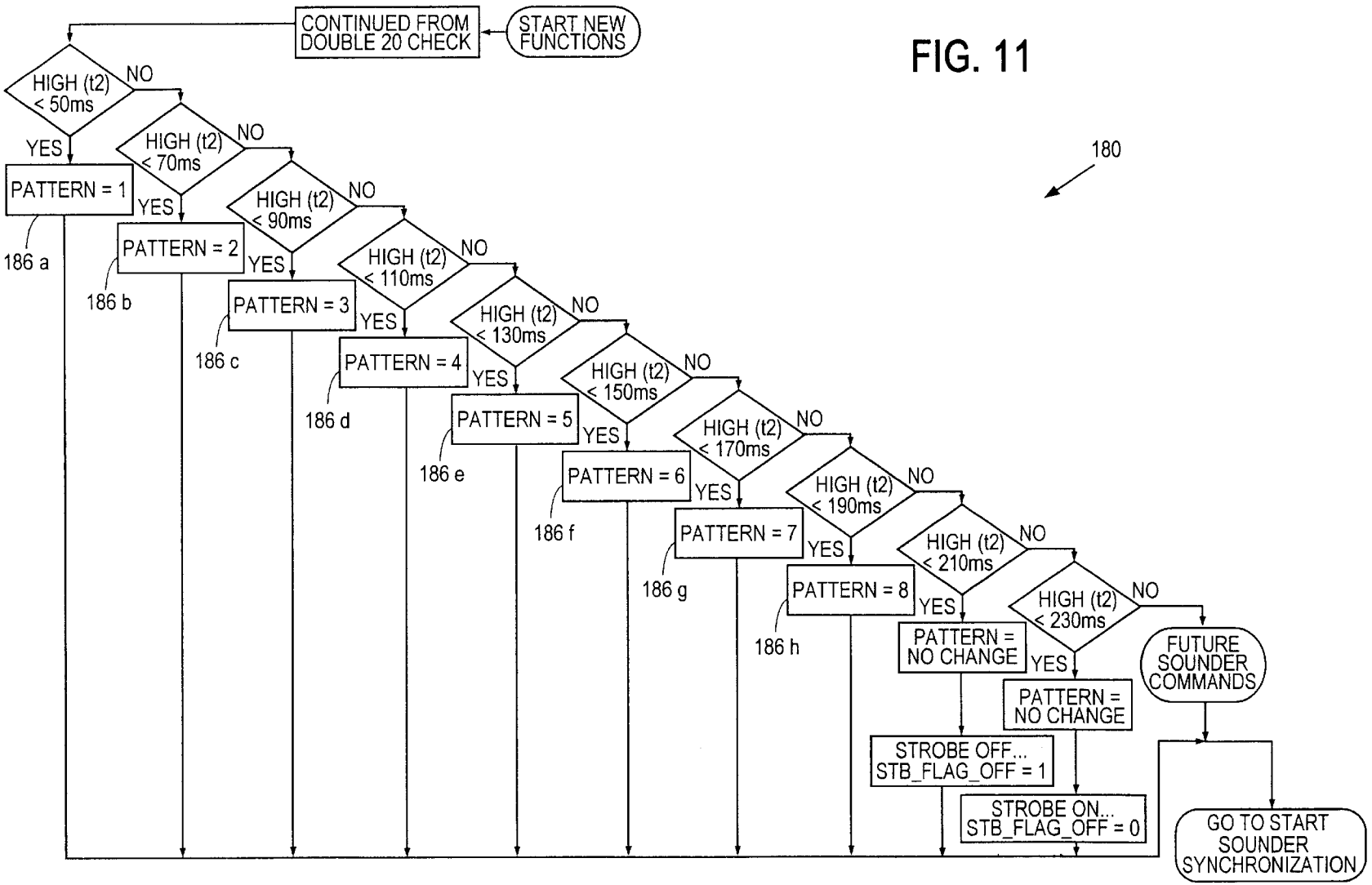

FIGS. 7–9 are flow diagrams illustrating processing by exemplary output module 26*i*. Such processing is also carried out in remaining members of the plurality 26, namely, 26*a, b* . . . n. FIGS. 10, 11 are flow diagram as illustrating processing carried out by output devices, such as output device 28*i* of FIG. 6.

The flow diagram of FIG. 7 illustrates processing steps 100 which respond to signals received on lines 34*a*, Power Input #1 as well as slave in port 38*a*. Where transitions are detected at slave in port 38*a*, the respective module is operating in a slave mode and will respond to the received transitions. Assuming applied power, DC or rectified AC, of a polarity to energize the respective module 26*i* (and no transitions at the slave in port 38*a*) processor 30*a* will operate in a Master Mode and execute steps 120, illustrated in FIG. 8, "Master Routine". Where temporal switch 32*e* has been selected, a modulated Temporal Output Pulse sequence is generated, step 122. Alternately, in response to analyzing the status of the horn enable port, step 124, one of several output sequence steps 126*a, b*, 128 and 130 can be executed.

Where one of the override ports 32*a, b* has been enabled and detected, steps 132*a, b* processor 30*c* implements steps 140, FIG. 9. As illustrated therein, switch settings are determined, steps 142*a–g* and respective modulated pulse sequences 144*a–h* are output to be received by the members of the pluralities 28*a, b, c* and *d*.

FIGS. 10, 11 together illustrate steps 160, 180 executed by an output device, such as the exemplary audible/visible output device 28*i* of FIG. 6, in accordance with the above described protocol. In step 162, a low synchronization signal P1 is detected. In step 164, the end of the synchronizing signal P1 has been detected.

In step 166, duration of the synchronization pulse is detected. If longer than 29 msec., less than 49 msec and greater than 34 msec, a 40 msec synch pulse has been detected, step 168. If less than 29 msec, step 166, duration of pulse t2 is been detected, step 168. If less than 29 msec, step 166, duration of pulse t2 is established steps 170*a, b, c*. If pulse t2 has a duration in excess of 24 msec, step 170*c*, device 28*i* executes steps 180, FIG. 11, decoding the received modulated pulse duration. The recognized pattern or control function is then executed, steps 186*a–h*.

The flow diagrams of FIGS. 7–11, as would be understood by those of skill in the art, could be implemented in the executable instructions stored in programmable read only memory of the respective output device.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A modular apparatus for an alarm system comprising:

programmable processing circuitry and an associated executable control program;

a first power input port for receipt of applied electrical energy of a selected polarity;

at least one input line for receipt of an electrical signal specifying an output sequence;

at least one communication sequence output port;

wherein the control program, in response to the presence of electrical signals with the selected polarity, and the specified output sequence couples electrical energy to the output port and couples a pulse train, causing an interruption in electrical energy, with an adjacent, variable energy supplying interval modulated by the specified output sequence to the output port.

2. An apparatus as in claim 1 which includes a synchronizing output port.

3. An apparatus as in clam 1 wherein a plurality of output devices is coupled to the output port.

4. An apparatus as in claim 3 wherein a common conductor is coupled between the output devices and a second input port of another, substantially similar module, and in response thereto the another module couples a corresponding output sequence to a respective output port.

5. An apparatus as in claim 1 which includes a second input port for receipt of a synchronizing communication sequence from another module and in the presence of a synchronizing communication sequence at the second input port couples another pulse train, corresponding to the synchronizing communication sequence, to the output port.

6. An apparatus as in claim 5 wherein the second input port is optically isolated.

7. An apparatus as in claim 1 wherein the pulse train exhibits a predetermined period and the members of the pulse train initiate the adjacent, variable interval subsequent to a respective energy interruption.

8. An apparatus as in claim 7 wherein the processing circuitry includes other circuitry for terminating the interval with a selected signal.

9. An apparatus as in claim 8 wherein the selected signal comprises an energy interrupting pulse.

10. A synchronizing system comprising:

a plurality of substantially identical synchronizing modules wherein each of the modules comprises:

an energy input port;

a control input port;

a synchronizing input port;

a synchronizing output port;

at least one loop output port; and, control circuits coupled to the ports wherein a conductor couples each loop output port to a synchronizing input port of another module, and wherein at least one output device is coupled to each conductor.

11. A system as in claim 10 wherein an end-of-line resistor is coupled to each conductor adjacent to the respective synchronizing input port.

12. A system as in claim 11 wherein one of the modules comprises a master module and receives a command signal at the control input port and wherein the control circuits therein respond to energy at the input port and to the command signal and generate at the loop output port a multi-section communication signal with an energy delivery section, a visible output device synchronizing section and a displaced section modulated in accordance with the command signal.

13. A system as in claim 12 wherein the modulation process comprises one of pulse width modulation, pulse position modulation, AM modulation and FM modulation.

14. A system as in claim 10 which includes a plurality of alarm indicating output devices coupled to at least one of the loop output ports.

15. A system as in claim 14 which includes at least first and second pluralities of alarm indicating output devices wherein one plurality is coupled to a loop output port of one module and a second plurality is coupled to a loop output port of a second module.

16. A system as in claim 14 wherein the alarm indicating output devices are selected from a class which includes audible output devices and visual output devices, and, wherein the respective output devices include circuitry to demodulate command and energy supplying signals supplied by a conductor coupled to the respective output devices.

17. A system as in claim 10 wherein each module includes a second loop output port.

18. A system as in claim 10 which includes power supplies coupled to at least some of the modules.

19. A system as in claim 17 wherein each loop output port is powered off of a separate power supply.

20. A communications process for audible and visual output devices comprising:

providing an energy supplying electrical signal;

providing an output-type designation;

generating a device communications electrical signal with an energy supplying part interrupted by a plurality of spaced apart, repetitive, visual synchronizing signals and including therebetween at least one interval bounding signal, wherein the interval varies in duration in accordance with the output-type designation.

21. A process as in claim 20 wherein the output-type designation comprises a multi-bit electrical signal.

22. A process as in claim 20 which includes controlling operation of at least one of a visual output device and an audible output device in accordance with the duration of the interval.

23. A process as in claim 22 wherein generating the synchronizing signals comprises generating an energy interrupting pulse bounded by first and second transitions wherein the pulses are repetitively generated with a predetermined, substantially constant period.

24. A process as in claim 22 wherein generating the interval bounding signal comprises generating an energy interrupting pulse bounded by first and second transitions wherein the pulses are selectively generated, at least in part in accordance with the output-type designation.

25. A method of operating an alarm indicating output device comprising:

receiving at a selected alarm indicating output device an energy supplying electrical signal and storing at least a portion of received energy for later use;

sensing the signal and establishing the presence of a sequence initiating indicator;

establishing the presence of a received command specifying interval embedded in the energy supplying signal, from a plurality of available command intervals, subsequent to the sequence initiating indicator; and carrying out a plurality of pre-determined steps to implement the received command so as to alter the operation of the selected output device.

26. A method as in claim 25 wherein the sensing and establishing steps includes detecting the presence of a sequence initiating, energy interrupting electrical pulse.

27. A method as in claim 26 which includes terminating the command specifying interval with a terminating electrical signal.

28. A method as in claim 27 wherein the terminating step comprises sensing the presence of an interval terminating, energy interrupting electrical pulse.

29. A method as in clam 25 wherein the plurality of commands comprises:

specifying an output illumination level from a plurality of available levels; and specifying an output audible sequence from a plurality of available sequences.

30. A method as in claim 25 which includes selectively switching an energy supplying electrical signal between a first, energy supplying value, and a second, non-energy supplying value.

31. A method as in claim 25 which includes reversing polarity of the electrical signal to a different inactive, non-energy supplying state.

32. A method as in claim 30 which includes reversing polarity of the electrical signal to a different inactive, non-energy supplying state.

33. An alarm indicating output device comprising:

a processor for executing prestored instructions;

an energy receiving input port with an input circuit coupled thereto wherein the input circuit provides command information, embedded in a modulated electrical signal received at the input port, to the processor wherein the processor in executing prestored instructions extracts a command from a pulse width modulated representation embedded in the modulated electrical signal, and, other instructions which implement the extracted command, wherein the implemented command is one of a plurality of visual alarm indicating output device control commands and one of a plurality of audible alarm indicating output device control commands.

34. An output device as in claim 33 which includes at last one of an audible output device and a visible output device.

35. An output device as in claim 33 which includes executable instructions for detecting synchronizing pulses received at the input port and further instructions for detecting a modulated command specifying interval received between at least some pairs of synchronizing pulses.

36. An output device as in claim 34 which includes executable instructions for detecting synchronizing pulses received at the input port and further instructions for detecting a modulated command specifying interval received between at least some pairs of synchronizing pulses.

37. An output device as in claim 36 which includes instructions for detecting an interval terminating pulse between respective pairs of synchronizing pulses, and instructions for controlling the at least one output device in accordance with the interval.

38. An alarm output device comprising:

an input port;

control circuits coupled to the input port; and an audible alarm indicating output device coupled to the control circuits wherein the control circuits respond to a pulse pattern, received at the input port, and, having circuits to establish a received interval start pulse and a received interval end pulse and circuitry for determining a command specifying interval duration and for executing one of an audible output and a visual output function specified by the determined duration thereby providing as an output a corresponding alarm output.

39. A device as in claim 38 wherein the control circuits comprise a programmed processor and a set of executable instructions wherein the instructions, in response to the pulse pattern received at the input port, determine the received command specifying interval.

40. A device as in claim 38 which includes a visual alarm indicating output device and additional instructions for synchronizing the visual output device with periodic interval start pulses.

41. An alarm indicating output device comprising:

a programmable processor;

an energy receiving/command receiving input port coupled to the processor;

an alarm indicating transducer coupled to the processor; and pre-stored instructions, executable by the processor, for demodulating an energy carrying signal received at the input port and for carrying out a respective transducer related function from a plurality of available functions.

42. An output device as in claim 41 which includes a manually settable, output specifying member coupled to the processor.

43. An output device as in claim 41 which includes circuitry and instructions for demodulating one of a pulse width modulated, a pulse position modulated, a phase modulated, a frequency modulated and an amplitude modulated signal received at the input port.

* * * * *